US011197530B2

(12) United States Patent
Long et al.

(10) Patent No.: US 11,197,530 B2
(45) Date of Patent: Dec. 14, 2021

(54) THREE-PHASE MAKEUP MIRROR

(71) Applicant: Timeless Makeup Mirror, LLC, Hobbs, NM (US)

(72) Inventors: Rebecca Long, Hobbs, NM (US); Glen Clifton, Marfa, TX (US); Curt Stewart, Caldwell, TX (US)

(73) Assignee: Timeless Makeup Mirror, LLC, Hobbs, NM (US)

( * ) Notice: Subject to any disclaimer, the term of this patent is extended or adjusted under 35 U.S.C. 154(b) by 236 days.

(21) Appl. No.: 16/467,747

(22) PCT Filed: Oct. 31, 2017

(86) PCT No.: PCT/US2017/059410
§ 371 (c)(1),
(2) Date: Jun. 7, 2019

(87) PCT Pub. No.: WO2018/081835
PCT Pub. Date: May 3, 2018

(65) Prior Publication Data

US 2019/0328113 A1 Oct. 31, 2019

Related U.S. Application Data

(60) Provisional application No. 62/414,927, filed on Oct. 31, 2016.

(51) Int. Cl.
*G02B 5/08* (2006.01)
*A45D 42/18* (2006.01)
(Continued)

(52) U.S. Cl.
CPC ..... *A45D 42/18* (2013.01); *A45D 42/10* (2013.01); *A45D 42/16* (2013.01); *A47G 1/04* (2013.01)

(58) Field of Classification Search
CPC ..... A45D 42/18; A45D 42/10; A45D 42/16; A45D 42/08; A45D 42/00; A47G 1/04;
(Continued)

(56) References Cited

U.S. PATENT DOCUMENTS 6,305,809 B1 * 10/2001 Zadro ..... G02B 5/10 359/855
7,090,378 B1 8/2006 Zadro

FOREIGN PATENT DOCUMENTS

CN 205568182 U 9/2016
GN 201870006 U 6/2011
(Continued)

OTHER PUBLICATIONS

Xin Wang; International Preliminary Reporton Patentability, PCT/US2017/059410; dated Oct. 31, 2017; 10 pages.
(Continued)

*Primary Examiner* — Euncha P Cherry
(74) *Attorney, Agent, or Firm* — Dickinson Wright PLLC; Kristopher Lance Anderson

(57) ABSTRACT

Disclosed is an invention in the field of cosmetic mirrors. The present invention particularly relates to a portable makeup mirror device comprising a first mirror, a second mirror, and a third mirror, each of varying mirror magnification factors, being supported by a freestanding frame, said makeup mirror device having the first mirror and second mirror pivoting and upwardly removed from the mirror housing in opposite directions, and once fully deployed are located on opposing sides of the mirror housing central aperture showing a third mirror fixed within the mirror housing. The freestanding frame has a base and a support member having a plurality of pivots for adjusting the base and mirror assembly.

23 Claims, 7 Drawing Sheets

(51) Int. Cl.

| | |
|---|---|
| ***A45D 42/10*** | (2006.01) |
| ***A45D 42/16*** | (2006.01) |
| *A47G 1/04* | (2006.01) |

(58) Field of Classification Search
CPC . A47G 2001/002; A47G 2200/08; G02B 5/08
See application file for complete search history.

(56) References Cited

FOREIGN PATENT DOCUMENTS

| | | | |
|---|---|---|---|
| GN | 204541172 | U | 8/2015 |
| JP | S49235 | Y1 | 1/1974 |
| JP | S6250511 | U | 3/1987 |
| WO | 2006126652 | A1 | 11/2006 |

OTHER PUBLICATIONS

Carl, Iris; International Search Report and Written Opinion, PCT/US2017/059410; dated Jan. 8, 2018; 16 pages.

* cited by examiner

300

THREE-PHASE MAKEUP MIRROR

CROSS-REFERENCE TO RELATED APPLICATIONS

This application is the 35 U.S.C § 371 national application of International PCT Application No. PCT/US17/59410, filed on Oct. 31, 2017, entitled "THREE-PHASE MAKEUP MIRROR," which designated the U.S., and which claims priority to U.S. Provisional Patent Application Ser. No. 62/414,927, filed on Oct. 31, 2016, entitled "THREE-PHASE MIRROR APPARATUS AND METHOD RELATED THERETO" of which is hereby incorporated herein by reference in its entirety for all purposes.

This application includes material that is subject to copyright protection. The copyright owner has no objection to the facsimile reproduction by anyone of the patent disclosure, as it appears in the Patent and Trademark Office files or records, but otherwise reserves all copyright rights whatsoever.

STATEMENT OF FEDERALLY FUNDED RESEARCH

None.

TECHNICAL FIELD

The present invention relates in general to the field of cosmetic mirror assemblies. In particular, the present invention relates to a three-phase mirror assembly for viewing varying magnifications in an illuminated display.

BACKGROUND OF THE DISCLOSURE

Cosmetic mirrors have long provided a user with the ability to view close up reflections for purposes of personal care activities, ranging from applying makeup to attending to medical treatment. Often, mirrors are present which provide increased levels of magnification, often with the use concave spherical mirrors, allowing for users to observe a larger image for purposes of enhancing personal care and application of cosmetics.

Prior cosmetic mirrors, including various vanity mirrors, makeup mirrors, compacts, and cosmetic organizers, are designed to provide various benefits: portability, size, multiple mirror types, multiple magnifications, lighting, free-standing, battery-powered, adjustable, and the like. However, many cosmetic mirrors are unable to capture all benefits. For example, in addressing the need for compact cosmetic mirrors, many products result in a reduced field of view. Other configurations may utilize multiple mirrors offering varying magnifications, but often the multiple mirrors are presented in a manner which prevents optimal use and lighting. The lighting itself may present difficulties, as ideal lighting requires consistent and fixed positioning, often preventing effective use of varying magnifications of multiple mirrors. Often, in addressing travel-sized mirrors, the ability to have more than two (2) mirrors of different magnification is restricted.

While these technological advances have allowed for many new functional designs of cosmetic mirrors, there remains a need in the art for portable, multiple-mirrored assemblies which maintain quality and ease of use.

SUMMARY OF THE DISCLOSURE

The present invention addresses failings in the art by providing a cosmetic mirror assembly and method that is compact, modular, portable, and provides ease of access to multiple mirrors having different magnifications while maintaining appropriate lighting of the desired mirror.

It is thus one object of the disclosure to provide an assembly having multiple mirrors having multiple magnifications, each capable of being presented within a lighted zone, without the need for flipping the mirror housing, rotating the mirror housing or utilizing multiple lighting assemblies.

It is a second object of this present invention to utilize a mirror housing that comprises a pivotally removable mirror dispensing assembly for removing a mirror magnification that is not desired away from a lighting zone to expose a desired mirror magnification remaining within the lighting zone. It is another object of the present invention for a user to effectively utilize one lighting zone for all available mirror magnifications. The present invention may be presented within a housing made of multiple materials. In another aspect the present invention may be free-standing on a surface, elevated from a plane via a base having a neck. In another aspect the base is capable of collapsing adjacent to, or in a planar or folded configuration with the mirror housing for storage and portability. In another aspect, the present invention may be affixed, or mounted, to a vertical plane, such as a wall or vanity, coupled with adjustable arms and swivels.

It is another object of the present invention to provide a mirror apparatus, comprising a mirror housing comprising a central aperture for viewing a mirror within a lighting zone, a first mirror having a first magnification factor removably stowed within the mirror housing, a second mirror having a second magnification factor removably stowed within the mirror housing, a third mirror having a third magnification factor fixed within the mirror housing, an adjustable neck assembly, and an adjustable base assembly, wherein the mirror housing further comprises a first swivel device pivotally connected to the mirror housing and the first mirror and a second swivel device pivotally connected to the mirror housing and the second mirror, each of the first and second swivel devices capable of pivoting respectively each of the first and second mirrors from a stowed position inside the mirror housing to outside the mirror housing. In another aspect, more than three mirrors are utilized using said mirror apparatus.

In one aspect of the present invention the stowed first mirror is positioned to be in front of the stowed second mirror within the mirror housing. In another aspect, the stowed second mirror is positioned to be behind the stowed front mirror within the mirror housing but in front of the fixed third mirror within the mirror housing. A lighting zone comprises a lighting assembly located substantially around the central aperture of the mirror housing which displays the desired mirror, wherein the first magnification factor, second magnification factor and third magnification factor are different levels of magnification ranging from −5× to 15×, for example 1×, 5×, and 10× respectively. In another aspect, the present invention provides the deployed first mirror and deployed second mirror positioned outside the central aperture of the mirror housing are located on opposing sides of the central aperture of the mirror housing. The adjustable base assembly and adjustable neck assembly are further selectively moveable behind the mirror housing for storage and portability.

It is therefore an object of the present invention to provide a mirror apparatus, comprising: a mirror housing comprising a central aperture for viewing a mirror within a lighting zone; a first mirror having a first magnification factor removably stowed within the mirror housing; a second mirror having a second magnification factor removably stowed within the mirror housing; a third mirror having a third magnification factor fixed within the mirror housing; an adjustable neck assembly; and an adjustable base assembly; wherein the mirror housing further comprises a first swivel device pivotally connected to the mirror housing and the first mirror and a second swivel device pivotally connected to the mirror housing and the second mirror, each of the first and second swivel devices capable of pivoting respectively each of the first and second mirrors from a stowed position inside the mirror housing to outside the mirror housing.

In one aspect the stowed first mirror is positioned to be in front of the stowed second mirror within the mirror housing. In another aspect the third mirror is positioned behind the stowed first mirror and stowed second mirror within the mirror housing. In another aspect the stowed second mirror is positioned to be behind the stowed first mirror within the mirror housing but in front of the fixed third mirror within the mirror housing.

In one aspect, the lighting zone comprises a lighting assembly located substantially around the central aperture of the mirror housing. In another aspect, the first magnification factor, second magnification factor and third magnification factor are different levels of magnification ranging from −5× to 15×. In one aspect the first magnification factor is 1×. In another aspect the second magnification factor is 5×. In another aspect the third magnification factor of 10×.

In another aspect, the deployed first mirror and deployed second mirror positioned outside the central aperture of the mirror housing are located on opposing sides of the central aperture of the mirror housing. In another aspect, the adjustable base assembly and adjustable neck assembly are selectively moveable behind the mirror housing for storage and portability.

It is another object of the present invention to provide a makeup mirror device, comprising: a mirror housing comprising a central aperture further comprising an illumination source effective in illuminating an object in front of the mirror housing, said illumination source at least partially circumscribing the central aperture; a first mirror having a first mirror magnification factor, said first mirror removably positioned inside the mirror housing wherein the reflecting side of the first mirror is visible within the central aperture of the mirror housing; a second mirror having a second mirror magnification factor, said second mirror removably positioned inside the mirror housing wherein the reflecting side of the second mirror is positioned behind the first mirror; and a third mirror having a third mirror magnification factor, said third mirror positioned inside the mirror assembly wherein the reflecting side of the third mirror is positioned within the central aperture of the mirror housing behind the removable first mirror and removable second mirror; wherein the removable first mirror having the first mirror magnification factor is capable of being upwardly withdrawn from the central aperture of the mirror housing, exposing the second mirror having the second mirror magnification factor to be visible within the central aperture of the mirror housing; and wherein the removable second mirror having the second mirror magnification factor, following withdrawal of the first mirror having the first mirror magnification factor from the central aperture, is capable of being withdrawn from the central aperture of the mirror housing, exposing the reflective side of the third mirror having the third mirror magnification factor to be visible within the central aperture of the mirror housing following withdrawal of the second mirror having the second mirror magnification factor.

In one aspect the withdrawn first mirror and second mirror are positioned on the first side and second side of the mirror housing, respectively, and wherein the reflecting side of each of the first mirror and second mirror are visible in the withdrawn position. In another aspect, wherein first mirror is capable of being upwardly withdrawn from the central aperture of the mirror housing via a swivel hinge located on a first side of the mirror housing. In another aspect, the second mirror is capable of being upwardly withdrawn from the central aperture of the mirror housing via a swivel hinge located on a second side of the mirror housing.

In one aspect the lighting zone comprises a lighting assembly located substantially around the central aperture of the mirror housing.

In another aspect the deployed first mirror and deployed second mirror are positioned outside the central aperture of the mirror housing are located on opposing sides of the central aperture of the mirror housing. In another aspect, an adjustable base assembly and adjustable neck assembly are each selectively moveable behind the mirror housing for storage and portability.

In another aspect, a wall mount or bracket is available in lieu of a neck assembly and base, allowing for suspending the makeup mirror device on a plane, such as a wall or vanity fixture. In another aspect, a locking mechanism, catch, or bracket the first mirror and second mirror within or outside the mirror housing.

The details of one or more embodiments of the present invention are set forth in the accompanying drawings and description below. Other aspects, features and advantages will be apparent from the description and drawings.

BRIEF DESCRIPTION OF THE DRAWINGS

The foregoing and other objects, features, and advantages of the disclosure will be apparent from the following description of embodiments as illustrated in the accompanying figures and drawings.

DETAILED DESCRIPTION OF THE DISCLOSURE

Figure 1:
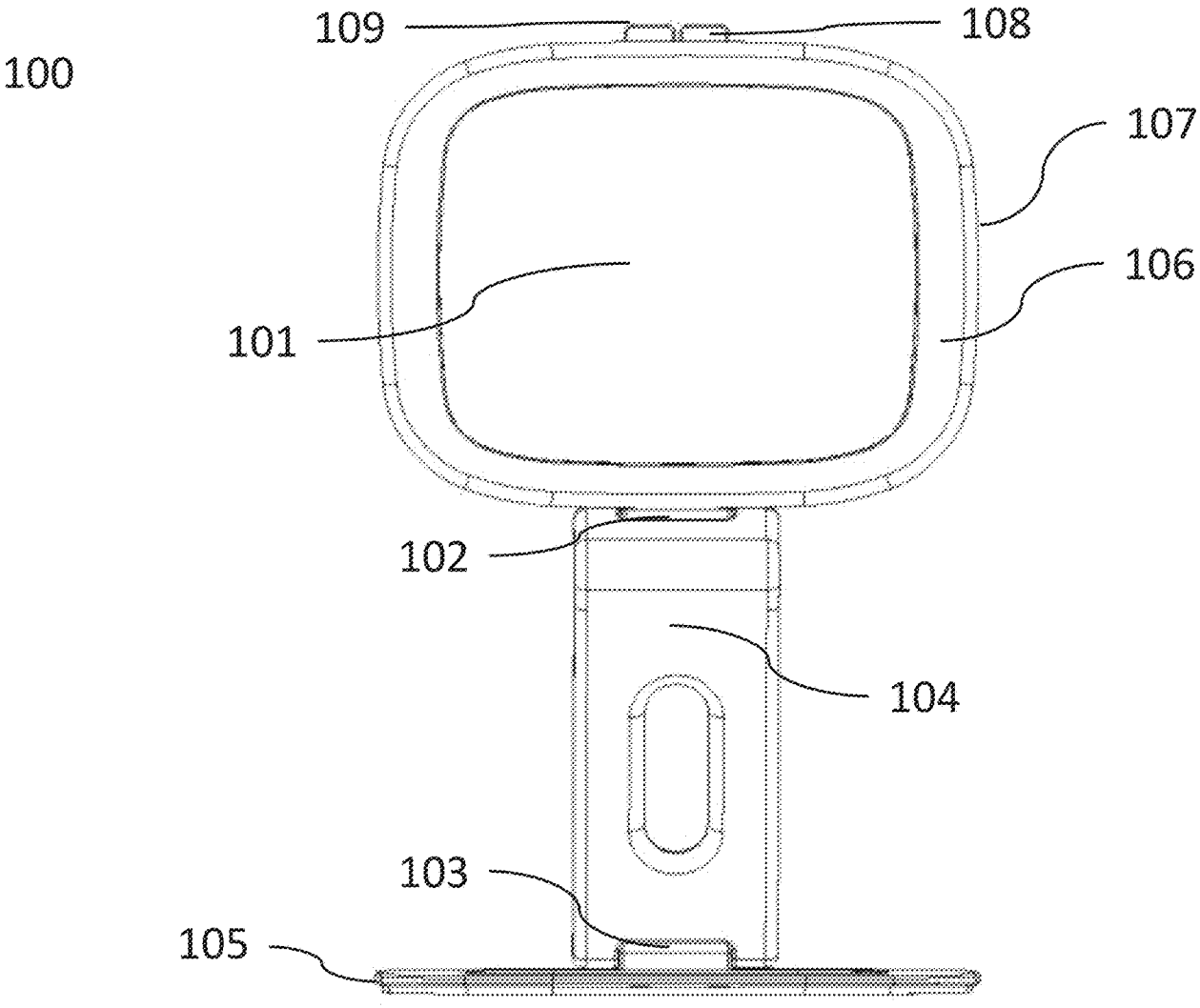
FIG. 1 depicts a front perspective view of the mirror apparatus of the present invention.

While the making and using of various embodiments of the present invention are discussed in detail below, it should be appreciated that the present invention provides many applicable inventive concepts that can be embodied in a wide variety of specific contexts, goods, or services. The specific embodiments discussed herein are merely illustrative of specific ways to make and use the disclosure and do not delimit the scope of the disclosure.

All publications and patent applications mentioned in the specification are indicative of the level of skill of those skilled in the art to which this disclosure pertains. All publications and patent applications are herein incorporated by reference to the same extent as if each individual publication or patent application was specifically and individually indicated to be incorporated by reference.

The present invention will now be described more fully hereinafter with reference to the accompanying figures and drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, compositions, processes, or systems. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

For the purposes of the present invention, a first mirror having a first magnification factor is provided. The first mirror is positioned within the mirror housing is a first position frontally located within the mirror housing. Thus, when in a closed position (i.e. all mirrors are located within the mirror housing), the first mirror is viewed within the lighting zone of the mirror housing. The lighting zone is the portion of the mirror housing which is lighted, typically on the periphery of a central aperture of the mirror housing. The central aperture of the mirror housing is frontally located on the apparatus. When surrounded by a lighting assembly, the central apparatus provides a user access to a mirror of the present invention along with adequate lighting for use.

The present invention further comprises a second mirror having a second magnification factor. The second mirror is positioned within the mirror housing in a second position, behind the first mirror. The second mirror having a second magnification factor may be viewed in the lighting zone when the first mirror is removed from the lighting zone, which occurs by pivotally moving the first mirror via a swivel device affixed to the mirror housing. The swivel device allows for the first mirror to be removed from the lighting zone allowing the second mirror to be viewable within the lighting zone. While the first mirror is still capable of being viewed when swiveled away from the lighting zone, the lighting is optimized for the viewable mirror within the lighting zone.

The present invention may further comprise a third mirror having a third magnification factor. The third mirror is positioned within the mirror housing in a third position, behind the second mirror. The third mirror having a third magnification factor may be viewed within the lighting zone when the first and second mirrors are removed from the lighting zone, which occurs by pivotally moving each of the first and second mirrors via a swivel device affixed to the mirror housing. While one swivel device may be used having both the first and second mirrors independently swivel using said swivel device, it is a preferred embodiment that the first and second mirrors each have a first and second swivel device, each located on opposing vertical ends of the mirror housing, in order to provide independent motion of the first and second mirrors as well as to display both the first and second mirrors when fully deployed away from the lighting zone. Further, by having each of the first and second mirrors located opposite of each other when fully deployed from the lighting zone, the mirrors help maintain balance of the mirror apparatus.

In one embodiment, the first mirror, second mirror, and third mirror provide a first, second, and third magnification factor, allowing the user to view varying levels of details when viewing the mirror apparatus. In an exemplary embodiment, the first, second and third mirrors provide a 1×, 5× and 10× magnification respectively. In another embodiment, the first, second and third mirrors provide a 1×, 2.5× and 5× magnification respectively. In yet another embodiment, the first, second and third mirrors are capable of providing a range of magnifications as desired, ranging from minus-5× to 15× respectively. The varying magnifications should be considered non-limiting to the mirror apparatus of the present invention, and may be provided in any magnification or combinations of magnifications.

For the purpose of the present invention, a lighting zone refers to a portion of the mirror housing which displays the central aperture comprising a mirror. In one embodiment, the lighting zone comprises one or more illumination devices positioned along the periphery of the central aperture. The illumination devices may be a light source comprising incandescent, fluorescent, light emitting diode (LED) or other light source. The light source may be battery powered (DC) or cord powered (AC) or both. The lighting zone may further comprise an adjustable feature for brightness or other lighting modulation, including wavelength. Motion sensing, backlight sensing, or other sensory instrumentation known in the art may be further incorporated for manipulating the illumination devices incorporated into the lighting zone.

For the purposes of the present invention a stand that is free standing supports the neck assembly pivotally attached to the mirror housing. The neck assembly may be a pivotally attached to the stand. The neck assembly may swivel on the x-axis via the swivel joint located between the stand and the neck assembly. The neck assembly may further swivel on the x-axis via the swivel joint located between the neck assembly and the mirror housing. In another embodiment, the swivel joint located between the neck assembly and mirror housing may further swivel on the y-axis.

Turning to the present invention, a preferred embodiment comprises a mirror apparatus comprising a mirror housing which houses a first mirror having a first magnification factor, a second mirror having a second magnification factor, and a third mirror having a third magnification factor. The first, second, and third mirrors are stored within the mirror housing. The mirror housing comprises a central aperture capable of viewing one of the mirrors within the aperture. The mirror housing may further comprise a lighting assembly located on the periphery of the central aperture allowing for adequate lighting of the central aperture, known as the lighting zone. The first mirror and second mirror are each pivotally affixed to the mirror housing via a swivel device. Each swivel device is capable of pivoting away respectively the first mirror and second mirror. The first and second mirror each has a protrusion, or tab, extending distally from the mirror housing. When pulled, the first or second mirrors are actuated to pivot out of the mirror housing and into a deployed position. In a preferred embodiment, the first mirror and second mirror are deployed opposite each other along the x-axis of the mirror housing. When fully deployed the first mirror is positioned on one side of the mirror housing. When fully deployed the second mirror is positioned on the side of the mirror housing opposite the first mirror. When the first mirror and second mirror are fully deployed, the third mirror, which is fixed within the lighting zone behind the stored position of the first mirror and second mirror, is then observable within the lighted zone.

In another exemplary embodiment, the mirror apparatus of the present invention provides a collapsible stand and neck assembly for purposes of portability. The neck assembly and base are both pivotally connected to the mirror housing, allowing for the neck assembly and base to collapse behind the mirror housing. In an alternative embodiment, the neck assembly and base are capable of collapsing in front of the mirror housing, adding further protective features to the central aperture of the mirror housing, where the stowed mirrors are located.

In another embodiment, a mirror apparatus comprises a mirror frame comprising a lighting feature surrounding a central aperture, a base, a base hinge, a first mirror attached to a first mirror front, and a first mirror back, a second mirror attached to a second mirror front and a second mirror back, a third mirror attached to a third mirror front and, if applicable, a third mirror back. In an alternative embodiment, the mirror apparatus comprises "n" mirror attached to n mirror front and n mirror back. The ability of the present invention to utilize n mirrors is indeed a function of thickness of the mirror housing. Therefore, up to ten mirrors may be operably used with the present invention. The mirror apparatus further comprises a neck portion, which may be comprised of a plastic front and back enclosing a stamped or machined rigid frame, such as metal, adjustably connectable to a base hinge and a head hinge. In one embodiment the neck comprises a curved "L" shaped upper region allowing for the mirror housing to operably fold along the neck in parallel to the mirror base for storage and travel.

Certain embodiments will now be described in greater detail with reference to the figures. Referencing FIG. 1, a mirror apparatus 100 of the present invention comprises a mirror housing 107 which houses a first mirror, second mirror and a third mirror. When all mirrors are stowed within the mirror housing 107, a central aperture of the mirror housing, referred to as the lighting zone 101, displays the reflective surface of first mirror. The lighting zone 101 is illuminated by the illumination device 106 located on the periphery of the lighting zone 101. The first and second mirrors are capable of being removed from the lighting zone 101 by pulling upward on the tabs 108, 109, thus actuating the first and second mirror upward and pivotally around the mirror housing 107. Once fully deployed, the first and second mirror will each be position on opposing ends of the mirror housing 107. A neck assembly 104 supports the mirror housing and is connected to the mirror housing via an adjustable joint 102. The adjustable joint 102 may be pivotal along the x-axis, y-axis, or both. The neck assembly 104 is further connected to a base 105, via a second adjustable joint 103. The second adjustable joint 103 may be pivotal along the x-axis, y-axis, or both.

Figure 2:
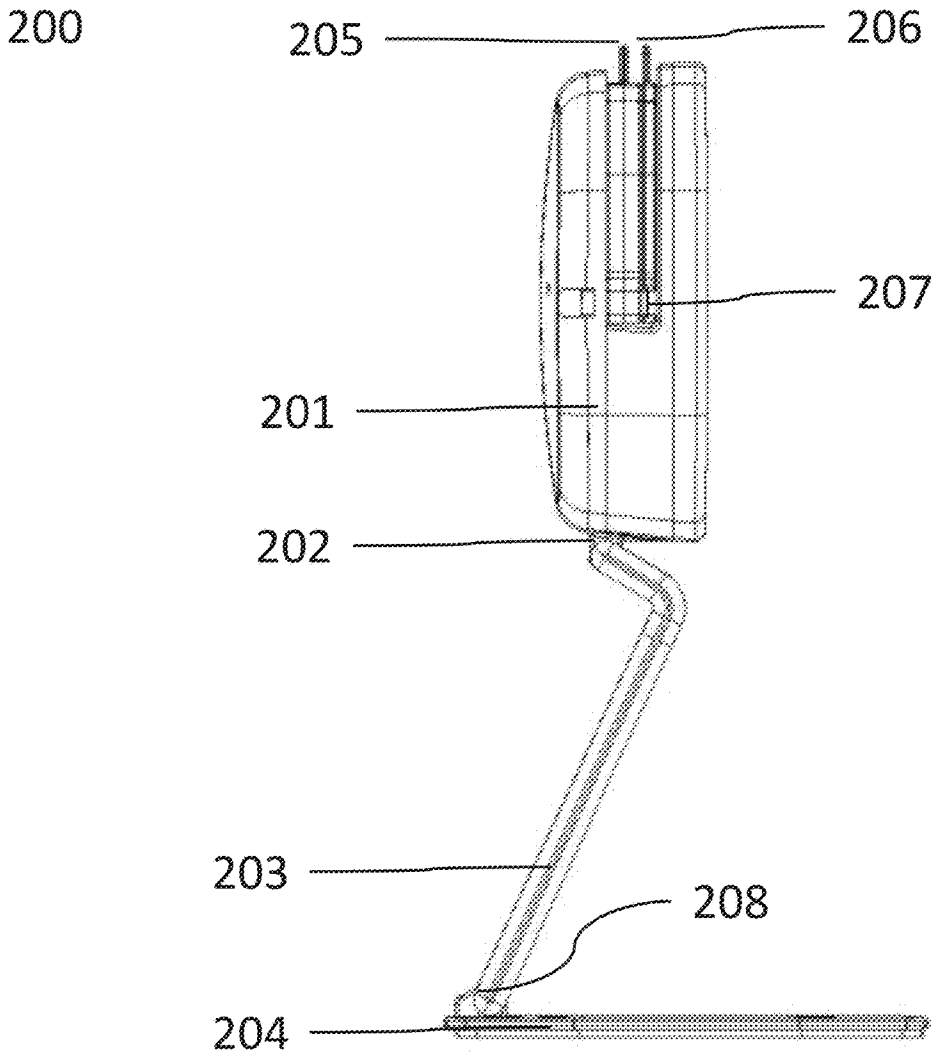
FIG. 2 depicts a side perspective view of the mirror apparatus of the present invention.

FIG. 2 provides an exemplary side perspective view of the mirror apparatus of the present invention 200. The mirror housing 201 comprises a first mirror, second mirror and third mirror. The first mirror and second mirror are each removable from the mirror housing 201 via a first swivel joint 207 and a second swivel joint (not shown). In FIG. 2, the first swivel joint 207 is for the first mirror, which may be actuated by pulling the first tab 206. The second mirror swivel joint is located on the opposite side of the first swivel joint 207, and is the second mirror may be actuated by pulling the second tab 205. The mirror housing is the supported by a neck assembly 203, which has a first adjustable joint 202 adjustably connected to the mirror housing 201, and a second adjustable joint 208, adjustably connected to the base 204. The base 204 is capable of provide for a freestanding mirror apparatus with adjustable height and position.

Figure 3:
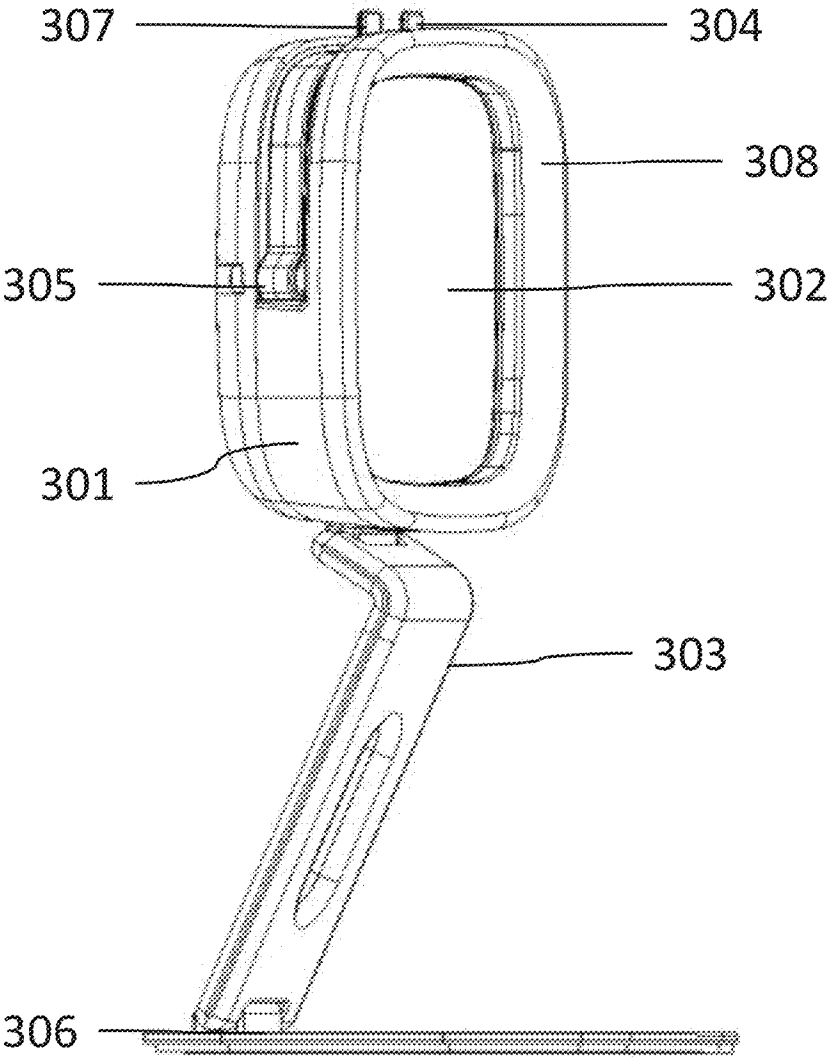
FIG. 3 depicts an isometric view of the mirror apparatus of the present invention.

Referencing FIG. 3 an isometric view of the mirror apparatus 300 of the present invention is shown. The mirror housing 301 is shown having a central aperture exposing a first mirror 302. Immediately encompassing the central aperture is the lighting assembly 308. The first mirror 302 exposed within the central aperture of the mirror housing 301 is then capable of being illuminated, as the central aperture, when lighted, is considered the lighting zone. Within the mirror housing 301 are a first mirror 302, a second mirror (not shown), and a third mirror (not shown). Tabs 304, 307 allow for the first mirror 302 and second mirror to be pivotally removed from the lighting zone. The first mirror 302 is affixed to a swivel joint 305. When the first mirror tab 304 is pulled the first mirror 302 is removed from the lighting zone, exposing the second mirror. When the second mirror tab 307 is pulled, the second mirror is pivotally removed via a second swivel joint (not shown) located opposite the first swivel joint 305 on the mirror housing 301. Once the first mirror 302 and second mirror (not shown) are pivotally removed from the central aperture, or lighting zone, the third mirror (not shown) is exposed within the lighting zone. The neck assembly 303 and the base 306 both adjustably support the mirror housing 301 as previously described.

Figure 4:
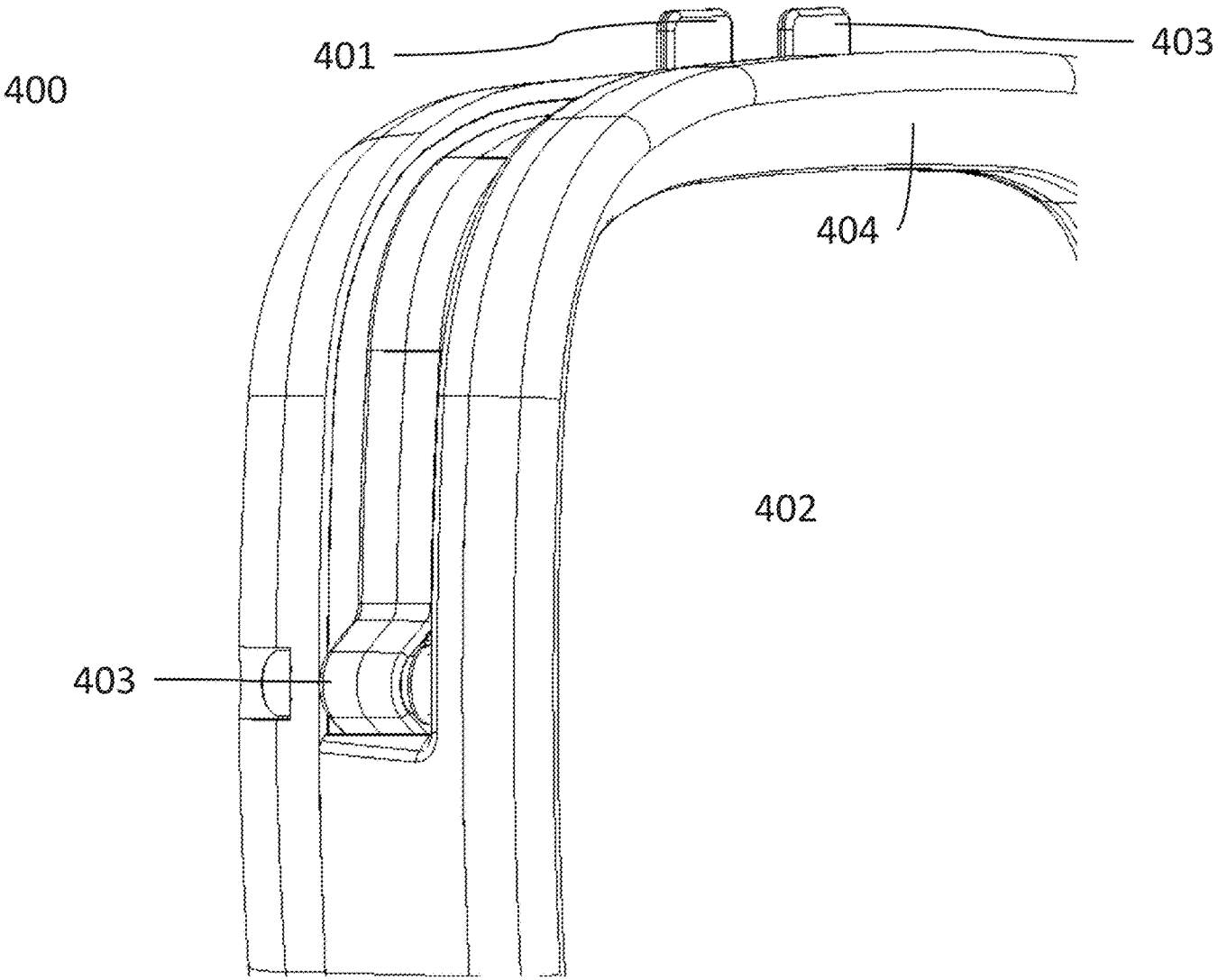
FIG. 4 depicts an exploded view of the mirror housing comprising the swivel device of the first and second mirrors.

Referencing FIG. 4 an exploded isometric view of the mirror housing 400 is presented. The mirror housing 400 is presented with both the first mirror 402 and the second mirror (not shown) in their closed position (i.e. within the mirror housing 400). The first mirror's reflective surface 402 is exposed within the central aperture of the mirror housing 400 referred to as the lighting zone. The central aperture is illuminated via a lighting assembly 404 which is peripheral to the lighting zone. The first mirror 402 is removable by pulling the first mirror tab 403 upward. The first mirror 402 pivots upward and outward around a central swivel joint 403. The first mirror 402, once fully deployed will rest outside the lighting zone, exposing the second mirror. The second mirror may then be deployed by pulling the second mirror tab 401 upward, allowing the second mirror to pivot upward and around a central swivel joint (not shown) located opposite the mirror housing 400 from the first swivel joint 403. Once the second mirror is fully deployed, the third mirror, fixed within the mirror housing, is exposed within the central aperture of the mirror housing 400, and thus within the lighting zone.

Figure 5:
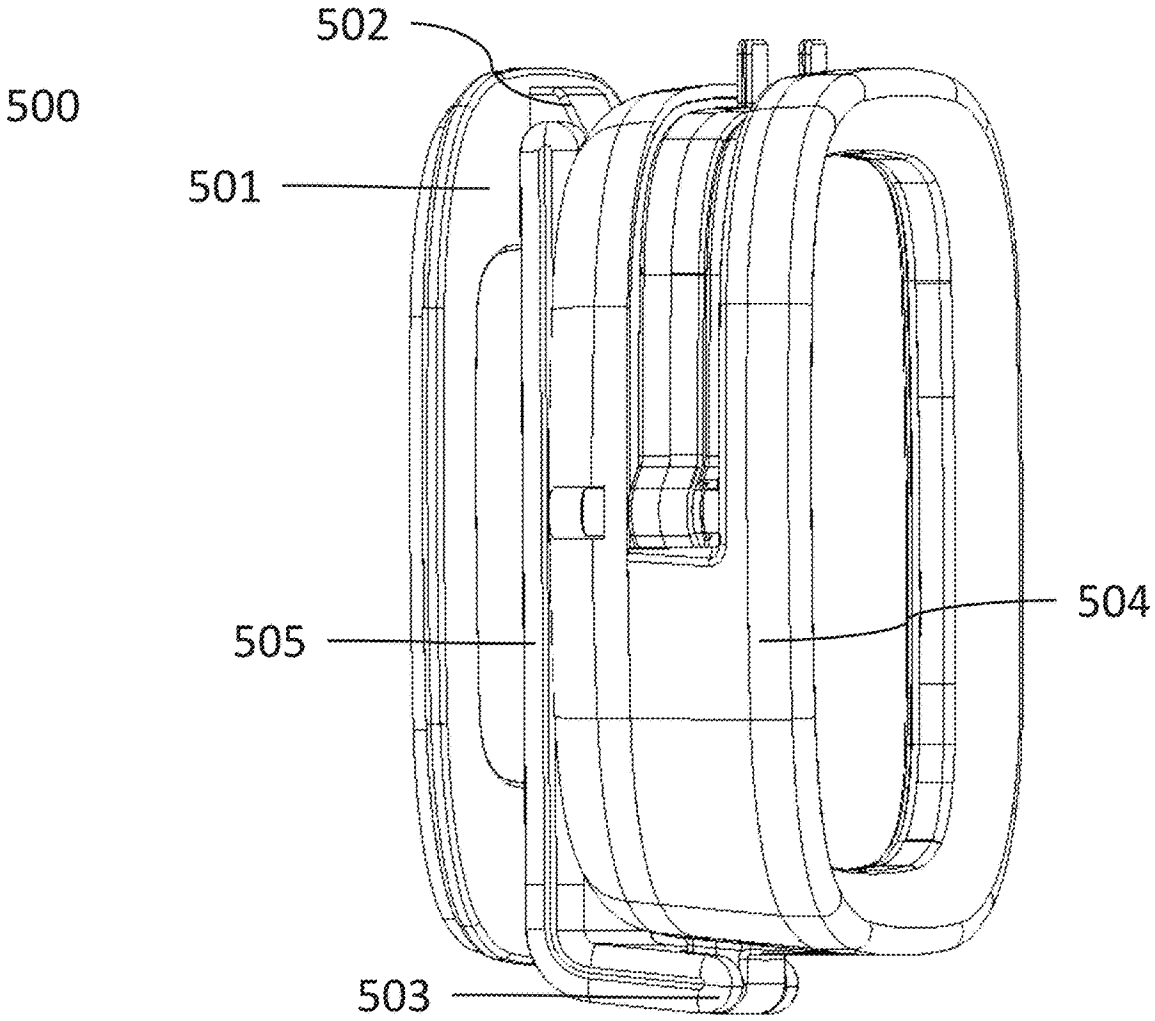
FIG. 5 depicts an isometric view of the mirror apparatus of the present invention in its closed position.

Referencing FIG. 5 an isometric view the mirror apparatus 500 in a closed position is provided. The mirror housing 504 is folded along a first pivoting joint 503 in connection with the neck assembly 505. The base 501 is similarly folded along a second pivoting joint 502 with the neck assembly 505. The closed position of the mirror apparatus 500 allows for portability during transport and storage, and the mirror apparatus 500 may further allow for travel scenarios, as the mirror housing 504 protects the mirrors during storage and handling. Once re-deployed, the base 501, neck assembly 505 and mirror housing 504 may be adjustably re-configured to ensure proper positioning for use.

Figure 6:
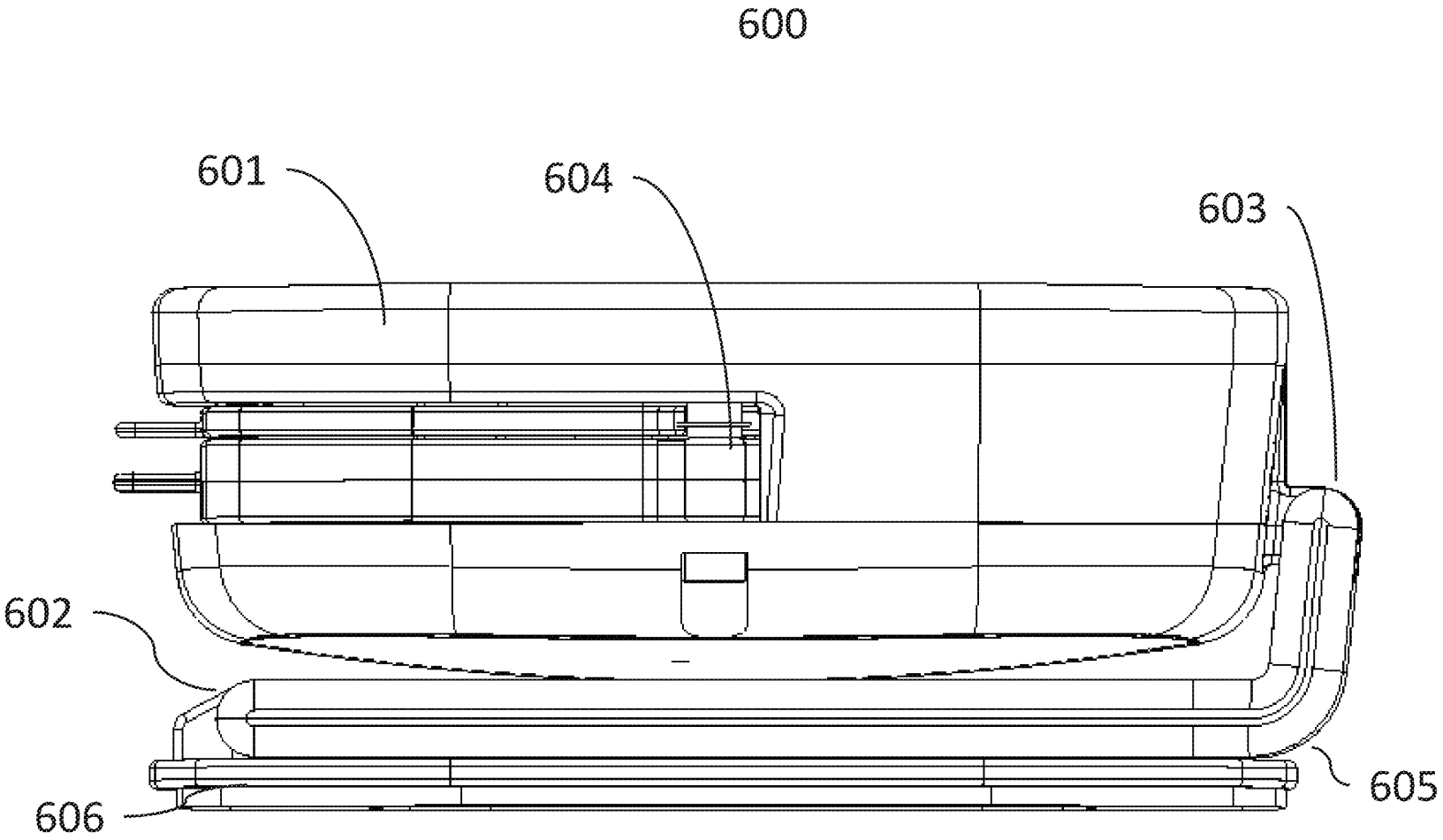
FIG. 6 depicts a side perspective view of the mirror apparatus of the present invention in its closed position.

Turning to FIG. 6, a side perspective view of the mirror apparatus 600 in a closed position is provided. All mirrors are stowed inside the mirror housing 601 via the swivel joint 604 (one on each opposing end of the mirror housing 601 for removal and stowage of the first mirror and second mirror. The mirror housing 601 is positioned facing upward and is pivotally connected to the neck assembly 605 via a first pivoting joint 603. The neck assembly 605 has a curved "L" shaped upper region capable of fitting around the contours of the mirror housing 601 for even seating of the mirror housing 601 along the neck assembly 605 and parallel to the base 606. The neck assembly 605 is further pivotally connected to the base 606 via a second pivoting joint 602.

Figure 7:
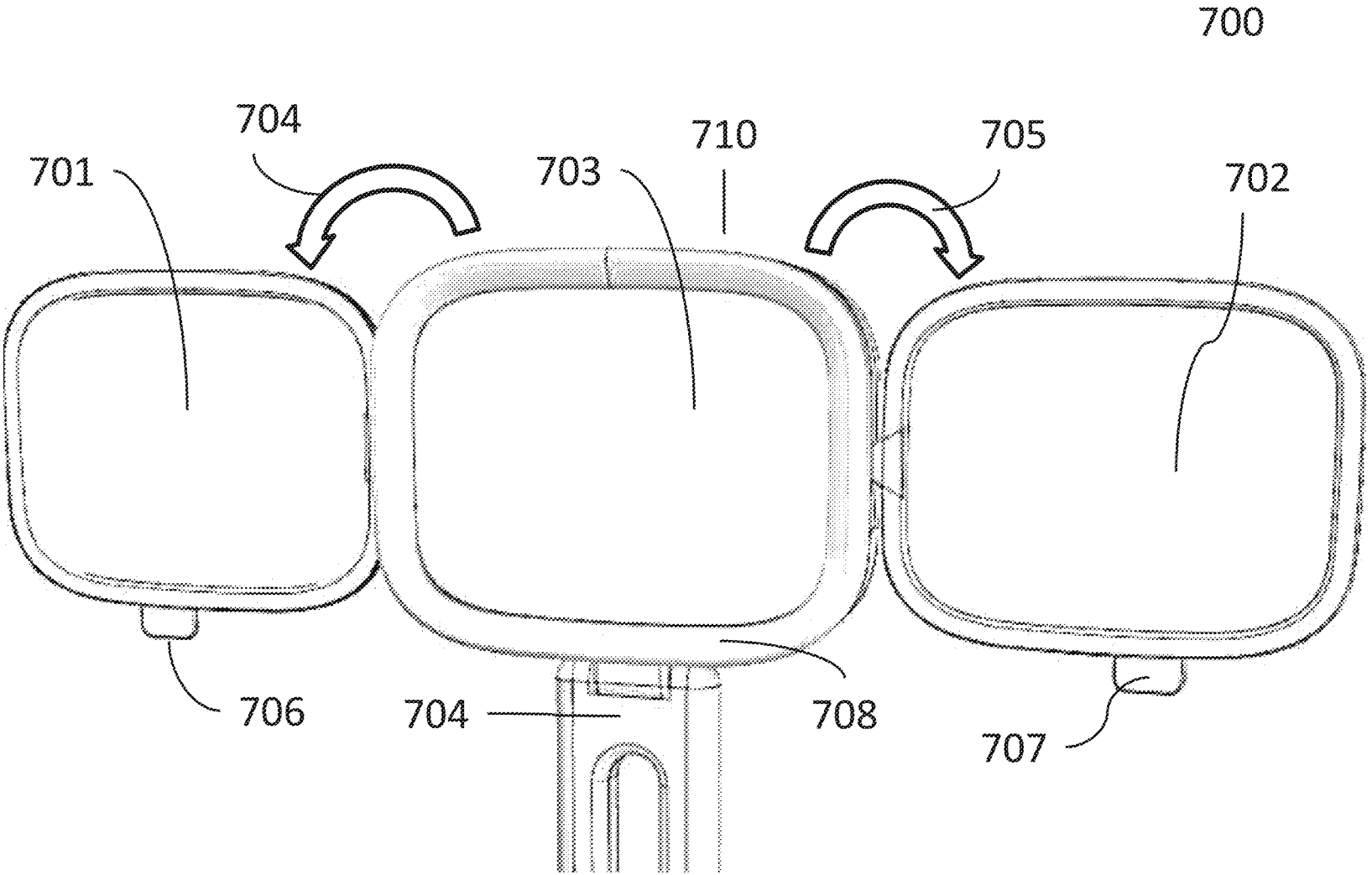
FIG. 7 depicts a front perspective view of the mirror apparatus with the first and second mirrors opened, exposing the third mirror within the lighting zone.

Referencing FIG. 7, the mirror apparatus 700 is shown with the first mirror 701 and second mirror 702 fully deployed from the mirror housing 710, exposing the third mirror 703 within the central aperture of the mirror housing 710, within the lighting zone illuminated by the lighting apparatus 708 extending around the periphery of the exposed third mirror 703. Referencing the first mirror 701, by pulling the first mirror tab 706 while in the closed position, the first mirror 701 is removed from the mirror housing 710 in an upward and outward pivot 704 around the applicable swivel joint (not shown). Referencing the second mirror 702, by pulling the second mirror tab 707 while in a closed position, the second mirror 702 is removed from the mirror housing 710 and an upward and outward pivot 705 around the applicable swivel joint (not shown). The mirror housing 710 is further pivotally connected to the neck assembly 704 and base (not shown). In another embodiment, the fully deployed first mirror 701 and second mirror 702 may further pivot along the y-axis to turn as applicable to allow a user to enjoy the third mirror 703 within the lighting zone while simultaneously viewing the first mirror 701 and second mirror 702 outside the lighting zone. While the first mirror 701 and second mirror 703 are not technically subject to the optimized lighting conditions of the lighting zone, their availability to the user while viewing the third mirror 703 provides additional reference and use of the first mirror 701 and second mirror 703 while fully deployed from the mirror housing 710.

In another embodiment, the tabs of the first mirror and second mirror further comprise a locking mechanism, such as a catch or other bracket for holding the first mirror and second mirror in their closed or open position. In another embodiment, a wall mount or bracket is utilized in lieu of a neck assembly and base, allowing for handing the mirror apparatus on a plane, such as a wall or vanity fixture for a more permanent use as in a hotel or resort room for use by patrons.

Those skilled in the art will recognize that the apparatus and methods of the present invention may be implemented in many manners and as such are not to be limited by the foregoing exemplary embodiments and examples. For example, in an alternative embodiment, the first and second mirrors may be pivotally removed in alternative directions, or via sliding mechanisms rather that via swivel joints. In other words, functional elements may be performed by single or multiple components, in various combinations of hardware and individual functions. In this regard, any number of the features of the different embodiments described herein may be combined into single or multiple embodiments, and alternate embodiments having fewer than, or more than, all of the features described herein are possible.

Functionality may also be, in whole or in part, distributed among multiple components, in manners now known or to become known. Thus, myriad hardware combinations are possible in achieving the functions, features, and preferences described herein. Moreover, the scope of the present invention covers conventionally known manners for carrying out the described features and functions, as well as those variations and modifications that may be made to the hardware components described herein as would be understood by those skilled in the art now and hereafter.

While various embodiments have been described for purposes of this disclosure, such embodiments should not be deemed to limit the teaching of this disclosure to those embodiments. Various changes and modifications may be made to the elements and operations described above to obtain a result that remains within the scope of the systems and processes described in this disclosure.

What is claimed is:

1. A mirror apparatus, comprising:
- a mirror housing comprising a central aperture for viewing a mirror within a lighting zone;
- a first mirror having a first magnification factor removably stowed within the mirror housing;
- a second mirror having a second magnification factor removably stowed within the mirror housing;
- a third mirror having a third magnification factor fixed within the mirror housing;
- an adjustable neck assembly; and
- an adjustable base assembly;
- wherein the mirror housing further comprises a first swivel device pivotally connected to the mirror housing and the first mirror and a second swivel device pivotally connected to the mirror housing and the second mirror, each of the first and second swivel devices capable of pivoting respectively each of the first and second mirrors from a stowed position inside the mirror housing to outside the mirror housing, wherein the stowed first mirror is positioned to be in front of the stowed second mirror within the mirror housing.

2. The mirror apparatus of claim 1, wherein the third mirror is positioned behind the stowed first mirror and stowed second mirror within the mirror housing.

3. The mirror apparatus of claim 1, wherein the stowed second mirror is positioned to be behind the stowed first mirror within the mirror housing but in front of the fixed third mirror within the mirror housing.

4. The mirror apparatus of claim 1, wherein the lighting zone comprises a lighting assembly located substantially around the central aperture of the mirror housing.

5. The mirror apparatus of claim 1, wherein the first magnification factor, second magnification factor and third magnification factor are different levels of magnification ranging from −5× to 15×.

6. The mirror apparatus of claim 5, wherein the first magnification factor is 1×.

7. The mirror apparatus of claim 5, wherein the second magnification factor is 5×.

8. The mirror apparatus of claim 5, wherein the third magnification factor if 10×.

9. The mirror apparatus of claim 1, wherein the deployed first mirror and deployed second mirror positioned outside the central aperture of the mirror housing are located on opposing sides of the central aperture of the mirror housing.

10. The mirror apparatus of claim 1, wherein the adjustable base assembly and adjustable neck assembly are selectively moveable behind the mirror housing for storage and portability.

11. A makeup mirror device, comprising:

a mirror housing comprising a central aperture further comprising an illumination source effective in illuminating an object in front of the mirror housing, said illumination source at least partially circumscribing the central aperture;

a first mirror having a first mirror magnification factor, said first mirror removably positioned inside the mirror housing wherein the reflecting side of the first mirror is visible within the central aperture of the mirror housing;

a second mirror having a second mirror magnification factor, said second mirror removably positioned inside the mirror housing wherein the reflecting side of the second mirror is positioned behind the first mirror; and a third mirror having a third mirror magnification factor, said third mirror positioned inside the mirror assembly wherein the reflecting side of the third mirror is positioned within the central aperture of the mirror housing behind the removable first mirror and removable second mirror;

wherein the removable first mirror having the first mirror magnification factor is capable of being upwardly withdrawn from the central aperture of the mirror housing, exposing the second mirror having the second mirror magnification factor to be visible within the central aperture of the mirror housing; and wherein the removable second mirror having the second mirror magnification factor, following withdrawal of the first mirror having the first mirror magnification factor from the central aperture, is capable of being withdrawn from the central aperture of the mirror housing, exposing the reflective side of the third mirror having the third mirror magnification factor to be visible within the central aperture of the mirror housing following withdrawal of the second mirror having the second mirror magnification factor.

12. The makeup mirror device of claim 11, wherein the withdrawn first mirror and second mirror are positioned on the first side and second side of the mirror housing, respectively, and wherein the reflecting side of each of the first mirror and second mirror are visible in the withdrawn position.

13. The makeup mirror device of claim 11, wherein first mirror is capable of being upwardly withdrawn from the central aperture of the mirror housing via a swivel hinge located on a first side of the mirror housing.

14. The makeup mirror device of claim 11, wherein second mirror is capable of being upwardly withdrawn from the central aperture of the mirror housing via a swivel hinge located on a second side of the mirror housing.

15. The makeup mirror device of claim 11, wherein the lighting zone comprises a lighting assembly located substantially around the central aperture of the mirror housing.

16. The makeup mirror device of claim 11, wherein the first magnification factor, second magnification factor and third magnification factor are different magnification factors ranging from −5× to 15×.

17. The makeup mirror device of claim 11, wherein the first magnification factor is 1×.

18. The makeup mirror device of claim 11, wherein the second magnification factor is 5×.

19. The makeup mirror device of claim 11, wherein the third magnification factor is 10×.

20. The makeup mirror device of claim 11, wherein the deployed first mirror and deployed second mirror positioned outside the central aperture of the mirror housing are located on opposing sides of the central aperture of the mirror housing.

21. The makeup mirror device of claim 11, further comprising an adjustable base assembly and adjustable neck assembly that are each selectively moveable behind the mirror housing for storage and portability.

22. The makeup mirror device of claim 11, further comprising a wall mount or bracket in lieu of a neck assembly and base, allowing for suspending the makeup mirror device on a plane, such as a wall or vanity fixture.

23. The makeup mirror device of claim 11, further comprising a locking mechanism, catch, or bracket holding the first mirror and second mirror within or outside the mirror housing.

* * * * *